US010103502B2

(12) United States Patent
Kondo

(10) Patent No.: US 10,103,502 B2
(45) Date of Patent: Oct. 16, 2018

(54) CONNECTOR HOLDER WITH INCLINATION PROTECTION

(71) Applicant: Sumitomo Wiring Systems, Ltd., Yokkaichi, Mie (JP)

(72) Inventor: Tomoyuki Kondo, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/559,474

(22) PCT Filed: Mar. 11, 2016

(86) PCT No.: PCT/JP2016/057727
§ 371 (c)(1),
(2) Date: Sep. 19, 2017

(87) PCT Pub. No.: WO2016/158311
PCT Pub. Date: Oct. 6, 2016

(65) Prior Publication Data

US 2018/0109045 A1 Apr. 19, 2018

(30) Foreign Application Priority Data

Mar. 31, 2015 (JP) ..... 2015-072167

(51) Int. Cl.
*H01R 13/66* (2006.01)
*H01R 13/40* (2006.01)

(52) U.S. Cl.
CPC ..... *H01R 13/6625* (2013.01); *H01R 13/40* (2013.01)

(58) Field of Classification Search
CPC ..... H01R 13/6633; H01R 13/6625; H01R 13/6641; H01R 9/2425
(Continued)

(56) References Cited

U.S. PATENT DOCUMENTS 4,772,225 A * 9/1988 Ulery ..... H01R 13/7195 29/854
5,932,808 A * 8/1999 Hayashi ..... G01L 9/0075 73/718
(Continued)

FOREIGN PATENT DOCUMENTS

JP 2001-176618 6/2001
JP 2014-157730 8/2014
(Continued)

OTHER PUBLICATIONS

International Search Report dated Jun. 7, 2016.

*Primary Examiner* — Tulsidas C Patel
*Assistant Examiner* — Marcus Harcum
(74) *Attorney, Agent, or Firm* — Gerald E. Hespos; Michael J. Porco; Matthew T. Hespos

(57) ABSTRACT

It is aimed to provide a connector capable of stably holding a holder in a housing and improving quality. A connector includes a capacitor (70) serving as an electrical component, terminals (50A, 50B) to be connected to the capacitor (70), a holder (30) for holding the terminals (50A, 50B) and the capacitor (70), and a housing (10) into which the holder (30) holding the terminals (50A, 50B) and the capacitor (70) is to be inserted. The terminal (50A) includes correcting portions (56) for correcting the inclination of the holder (30) in the housing (10) by coming into contact with the housing (10) from inside.

8 Claims, 7 Drawing Sheets

(58) Field of Classification Search
USPC ..... 439/620.22, 620.09, 620.13, 620.02, 439/620.21, 356
See application file for complete search history.

(56) References Cited

U.S. PATENT DOCUMENTS

| | | | | |
|---|---|---|---|---|
| 6,678,164 | B2 * | 1/2004 | Chikuan | G01L 19/0084 361/752 |
| 8,529,297 | B2 * | 9/2013 | Chang | H01R 13/6658 439/620.09 |
| 8,624,689 | B2 * | 1/2014 | Hsieh | H01R 13/6608 333/185 |
| 8,870,599 | B2 * | 10/2014 | Takemoto | H01R 13/6625 439/620.21 |
| 9,209,579 | B2 * | 12/2015 | Mochizuki | H01R 13/506 |
| 9,379,496 | B2 * | 6/2016 | Hashimoto | H01R 13/6625 |
| 2009/0298341 | A1 * | 12/2009 | Ellis | H01R 13/6658 439/620.22 |
| 2011/0275244 | A1 * | 11/2011 | Duesterhoeft | H01R 13/113 439/620.21 |
| 2012/0052730 | A1 * | 3/2012 | Takemoto | H01R 13/6315 439/620.21 |
| 2012/0129392 | A1 * | 5/2012 | Fujisaki | H01R 13/521 439/587 |
| 2014/0220823 | A1 | 8/2014 | Ando et al. | |
| 2015/0004841 | A1 | 1/2015 | Fujiwara et al. | |

FOREIGN PATENT DOCUMENTS

| | | |
|---|---|---|
| JP | 2014-170725 | 9/2014 |
| JP | 201511853 | 1/2015 |

* cited by examiner

CONNECTOR HOLDER WITH INCLINATION PROTECTION

BACKGROUND

1. Field of the Invention

The invention relates to a connector.

2. Description of the Related Art

Japanese Unexamined Patent Publication No. 2014-170725 discloses a connector with a built-in electrical component, such as a capacitor. The capacitor is held in a holder and is connected by resistance welding to a busbar piece that also is held in the holder. The holder that holds the busbar piece and the capacitor is inserted into a bag-shaped housing. The busbar piece is provided with a holder press-fit portion and a housing press-fit portion. The holder is held in the housing via the busbar piece by press-fitting the holder press-fit portion and the housing press-fit portion respectively into the holder and the housing.

The holder may be inclined from a proper insertion posture during insertion into the housing. In this situation, the housing press-fit portion is press-fit in an oblique direction into the housing and the holder may be held in a posture inclined with respect to the housing. If the holder is inclined, the alignment of the busbar piece with a mating terminal varies in each product and it may become difficult to maintain constant quality.

The invention was completed based on the above situation and aims to provide a connector capable of stably holding a holder in a housing and improve quality.

SUMMARY

The invention is directed to a connector with an electrical component, a terminal to be connected to the electrical component, a holder for holding the terminal and the electrical component, and a housing into which the holder holding the terminal and the electrical component is to be inserted. The terminal includes a correcting portion for correcting the inclination of the holder in the housing by coming into contact with the housing from inside.

The correcting portion of the terminal contacts the housing from inside to correct the inclination of the holder during insertion into the housing. Thus, the holder can be held stably held in a proper posture in the housing. As a result, a variation of the alignment of the terminal with respect to a mating terminal can be suppressed and quality can be improved. Further, since the correcting portion is provided on the terminal and comes into contact with the housing from inside, the holder and the housing need not be changed substantially from a conventional structure.

The correcting portion may project from a body part of the terminal and may be resiliently deformable. According to this configuration, the correcting portion is deformed resiliently to deform an assembling error between the terminal and the housing.

The housing may include an insertion hole through which the electrical component is to be inserted and a clearance may be provided between a wall surface on a side where the insertion hole is located and the holder, and the correcting portion may be configured to contact the wall surface on the side where the insertion hole is located. By providing the housing with the insertion hole, the inclination of the holder may be guided toward the side where the insertion hole is located. However, in the case of this configuration, the correcting portion comes into contact with the wall surface on the side where the insertion hole is located. Thus, the concerned inclination of the holder can be suppressed effectively.

Two correcting portions may be provided to contact both side parts of the wall surface of the housing across the insertion hole. Thus, inclination of the holder in the housing can be suppressed in a well-balanced manner.

DETAILED DESCRIPTION

Figure 1:
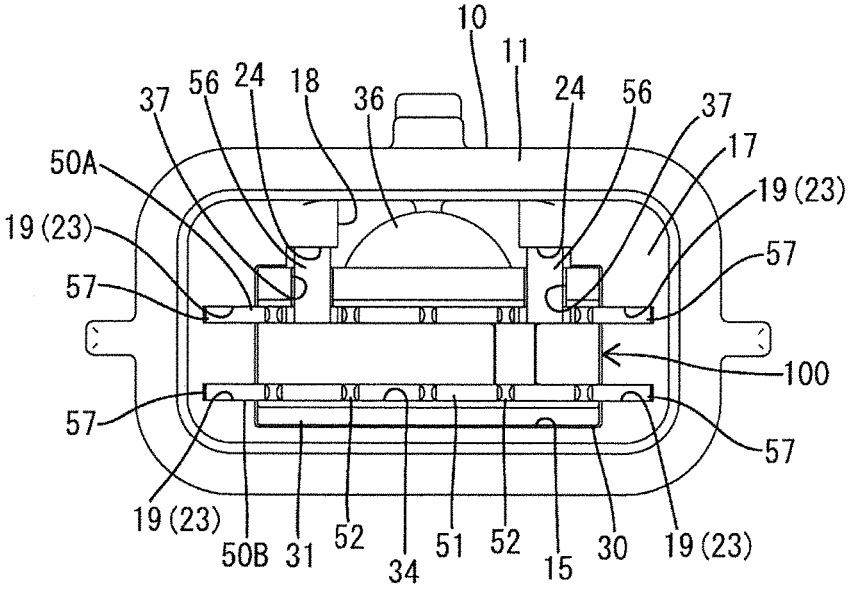
FIG. 1 is a front view of a connector according to an embodiment of the present invention.
Figure 2:
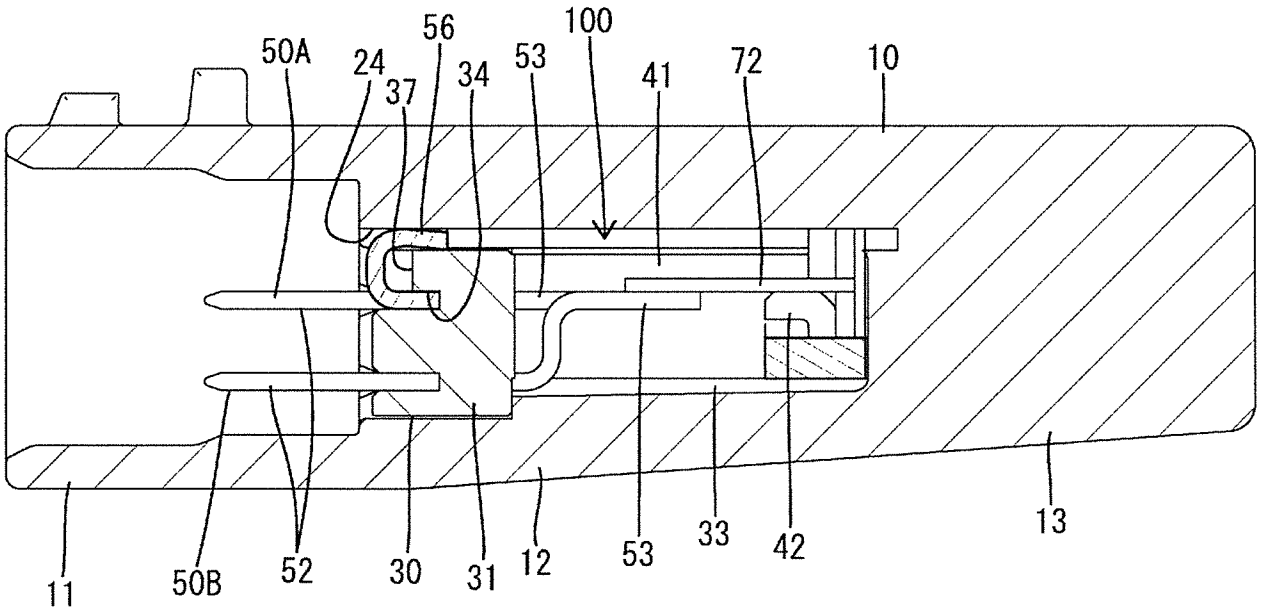
FIG. 2 is a side view in section of the connector.
Figure 3:
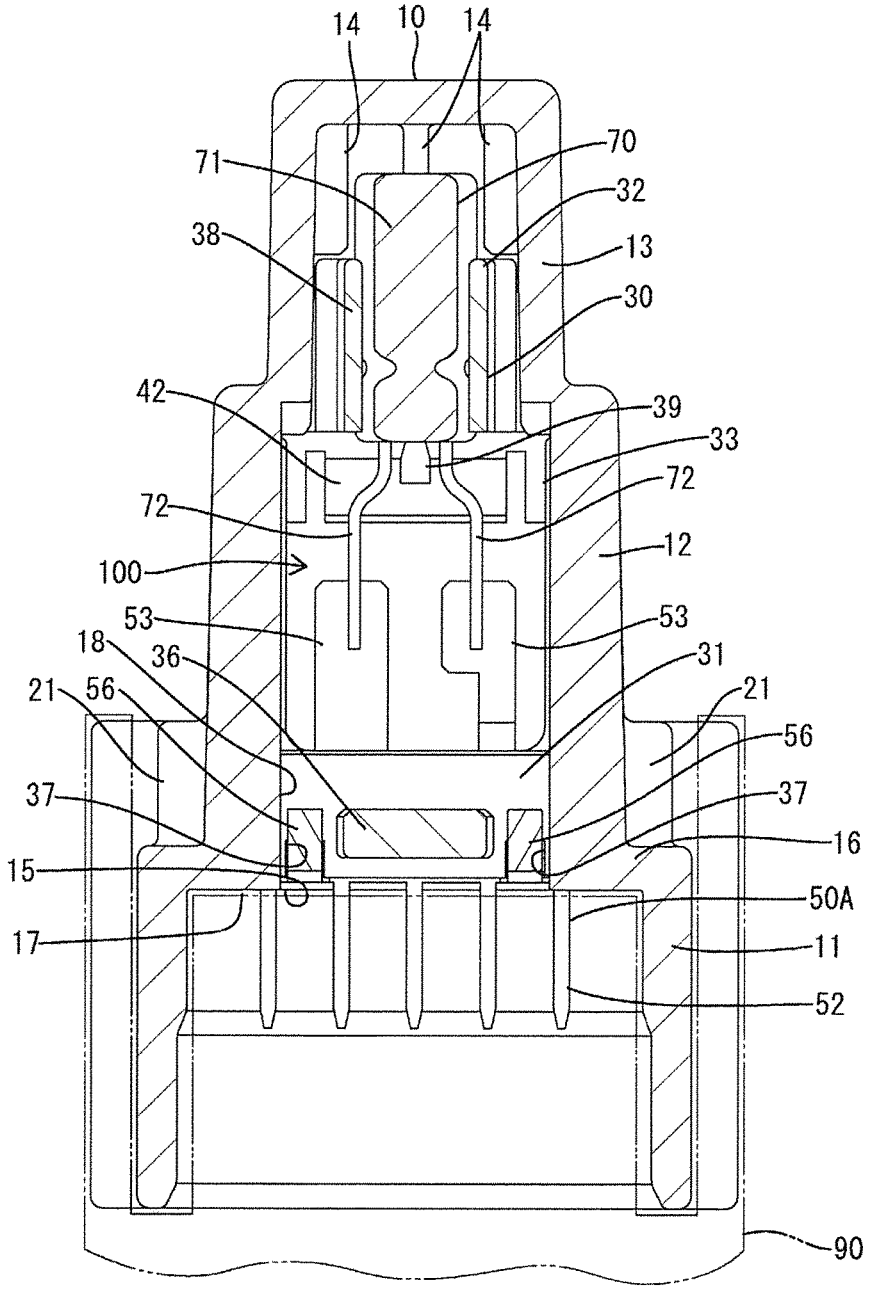
FIG. 3 is a plan view in section of the connector.

An embodiment is described with reference to FIGS. 1 to 7. A connector according to the embodiment is configured for removing noise of an electrical device or the like mounted in an automotive vehicle, and includes a housing 10, a holder 30, terminals 50A, 50B and a capacitor 70 as an electrical component serving as a noise filter. The terminals 50A, 50B and the capacitor 70 are held in the holder 30 to configure a subassembly 100 (see FIGS. 4 to 6) and, thereafter, the subassembly 100 is accommodated into the housing 10 (see FIGS. 1 to 3). Note that, in the following description, a surface side of the housing 10 to be connected to a mating housing 90 shown in FIG. 3 is referred to as a front concerning a front-rear direction, and a vertical direction is based on FIGS. 1, 2, 4 and 6. Further, a lateral direction is based on FIGS. 1, 3 and 5 to 7.

Figure 7:
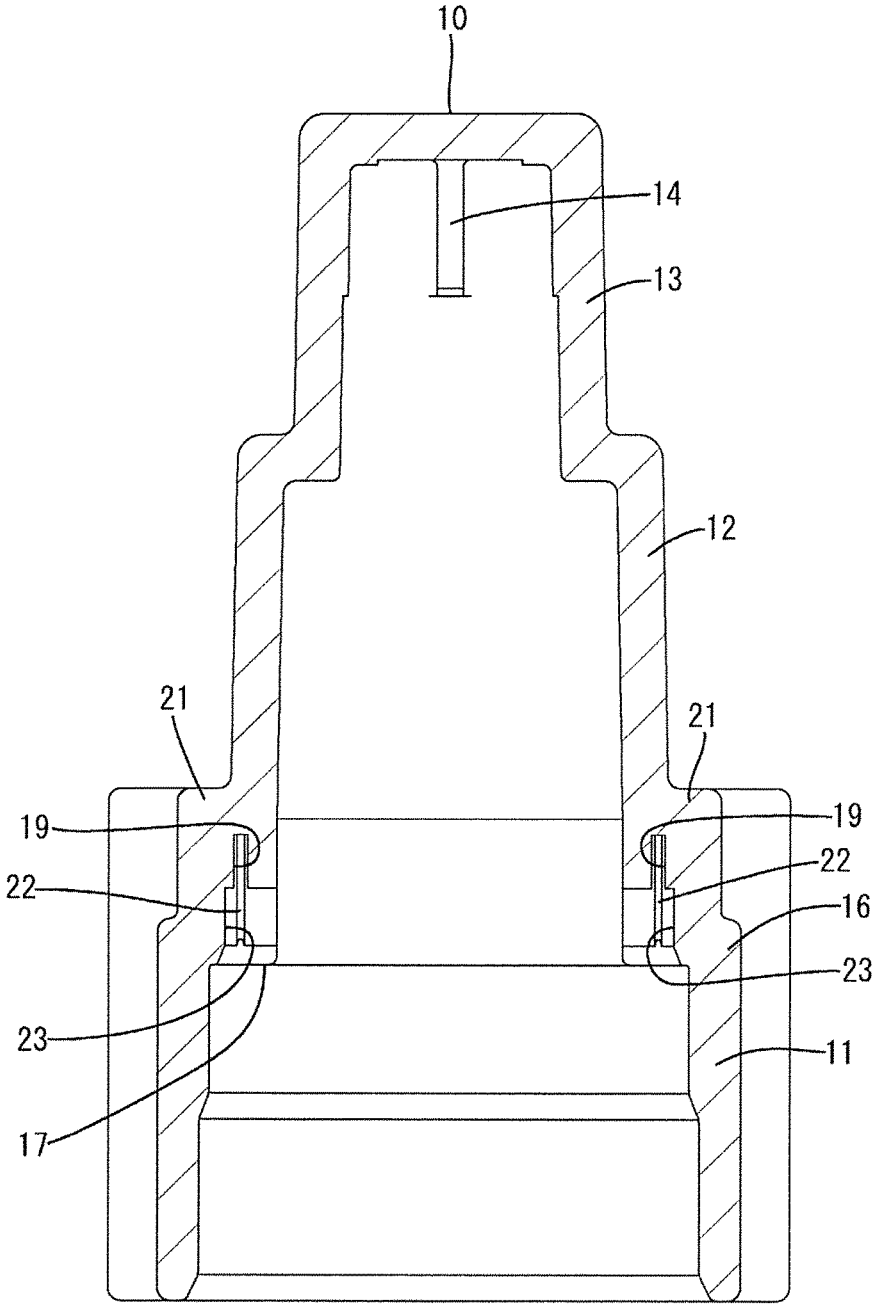
FIG. 7 is a plan view in section of a housing.

The housing 10 is made of synthetic resin and, as shown in FIG. 7, resembles a forwardly open bag with a receptacle 11, a holder accommodating portion 12 and an electrical component accommodating portion 13 successively provided one after another from the front. The housing 10 is formed such that an opening width is gradually reduced in an order of the receptacle 11, the holder accommodating portion 12 and the electrical component accommodating portion 13.

The holder 30, in the form of the subassembly 100, is inserted into the housing from the front. The holder 30 is inserted into the housing 10, as shown in FIG. 3, so that an intermediate part of the holder 30 is accommodated in the holder accommodating portion 12 and the capacitor 70 is accommodated in the electrical component accommodating portion 13. Further, the mating housing 90 is fittable into the receptacle 11.

As shown in FIGS. 3 and 7, projections 14 are provided on upper, lower, left and right sides of the inner peripheral surface of the electrical component accommodating portion 13 extending in the front-rear direction. When the capacitor 70 is accommodated into the electrical component accommodating portion 13, each projection 14 is arranged in proximity to the outer periphery of the capacitor 70 to restrict a loose movement of the capacitor 70 in the electrical component accommodating portion 13.

As shown in FIG. 3, the receptacle 11 has a back wall 16 with an opening 15 that faces the front end of the holder accommodating portion 12. The back wall 16 has a forwardly facing back surface 17 that defines a boundary between the receptacle 11 and the holder accommodating portion 12. As shown in FIG. 1, the back wall 16 has an insertion hole 18 communicating with the upper edge of the opening 15. Press-fit holes 19 are open in both left and right parts of the back surface 17 and communicate with both left and right side edges of the opening 15.

The insertion hole 18 penetrates through the upper wall of the holder accommodating portion 12 and communicates with the interior of the electrical component accommodating portion 13. An upper end part of the capacitor 70 passes through the insertion hole 18 in the process of inserting the holder 30, and a later-described closing wall 36 of the holder 30 is arranged inside the insertion hole 18 when the assembling of the holder 30 is completed.

As shown in FIG. 3, the outer surface of the holder accommodating portion 12 is padded on both left and right sides of the back wall 16 to provide thick portions 21. Upper and lower press-fit holes 19 are provided in each of the thick portions 21 on both left and right sides. As shown in FIG. 7, the press-fit hole 19 extends in the front-rear direction and the rear end thereof is closed in the thick portion 21. Ribs 22 are provided on both upper and lower surfaces of the press-fit hole 19 and extend in the front-rear direction. Further, the thick portion 21 is provided with slit holes 23 by widening front parts of the press-fit holes 19 toward both left and right sides. Later-described housing press-fit portions 54 of the terminal 50A, 50B are press-fit into the press-fit holes 19, and both left and right end portions 57 of later-described bases 51 of the terminals 50A, 50B are press-fit into the slit holes 23.

Further, as shown in FIG. 1, contact receiving holes 24 are open at both left and right sides across the opening 15 in the upper end part on the back surface 17 of the back wall 16 of the receptacle 11. As shown in FIG. 2, the contact receiving hole 24 extends in the front-rear direction and the rear end thereof is closed by a step to the electrical component accommodating portion 13. The upper surface of the contact receiving hole 24 is flat along the front-rear direction, and a later-described correcting portion 56 of the terminal 50A comes into contact with this upper surface.

The terminals 50A, 50B are conductive metal plate members and are configured as upper and lower busbars corresponding to a positive electrode and a negative electrode of the capacitor 70. Specifically, as shown in FIG. 5, the terminal 50A, 50B is composed of the base 51 in the form of a strip long in the lateral direction, tabs 52 projecting forward side by side from the front edge of the base 51 and an electrical component connecting portion 53 projecting rearward from the rear edge of the base 51.

As shown in FIG. 2, the electrical component connecting portion 53 of the upper terminal 50A is arranged substantially horizontally. On the other hand, the electrical component connecting portion 53 of the lower terminal 50B is bent in a height direction and a rear part thereof is arranged side by side with the electrical component connecting portion 53 of the upper terminal 50A substantially at the same height.

Figure 5:
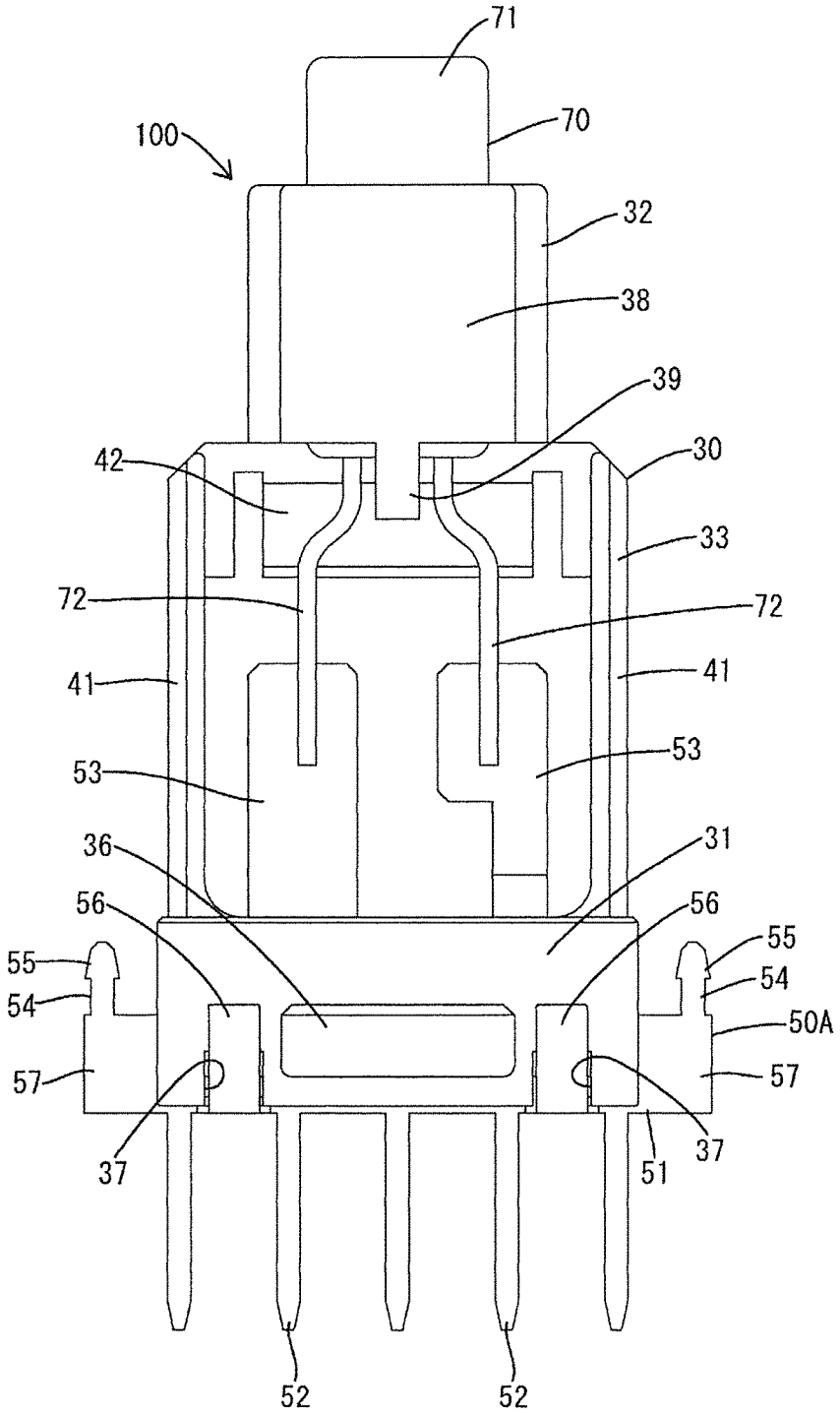
FIG. 5 is a plan view of the subassembly.

As shown in FIG. 5, later-described lead wires 72 of the capacitor 70 are connected to rear parts of the electrical component connecting portions 53 of the terminals 50A, 50B. Further, front parts of the electrical component connecting portions 53 of the terminals 50A, 50B are press-fit into later-described terminal mounting grooves 34 of the holder 30 together with the bases 51.

As shown in FIG. 5, the housing press-fit portions 54 project rearward on the rear edges of the both left and right end portions 57 of the base 51. A wider press-fit projection 55 is provided on a rear end part of the housing press-fit portion 54. When the housing press-fit portions 54 are press-fit into the press-fit holes 19, the press-fit projections 55 are locked to back end parts of the press-fit holes 19 so that the terminals 50A, 50B are retained in the housing 10. At this time, the ribs 22 of the press-fit holes 19 come substantially into line contact with the housing press-fit portions 54 so that a press-fit force need not be excessively large and a press-fit state is maintained satisfactorily.

Figure 4:
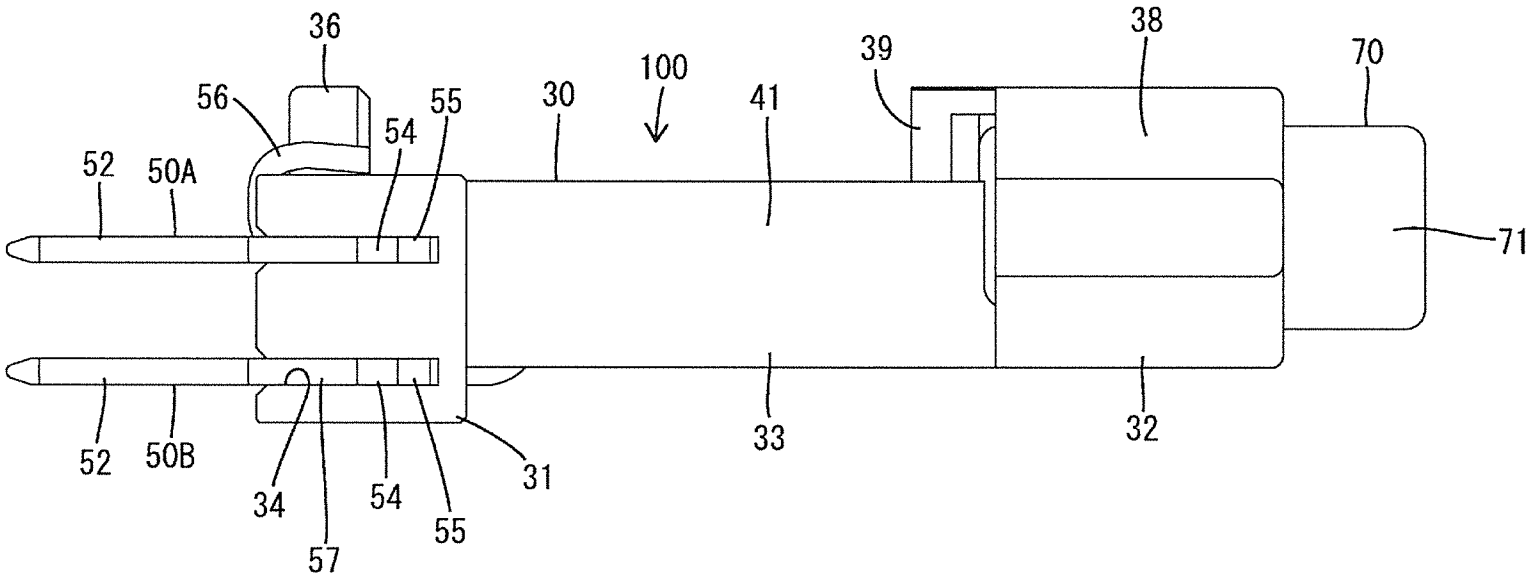
FIG. 4 is a side view of an subassembly composed of terminals, an electrical component and a holder.
Figure 6:
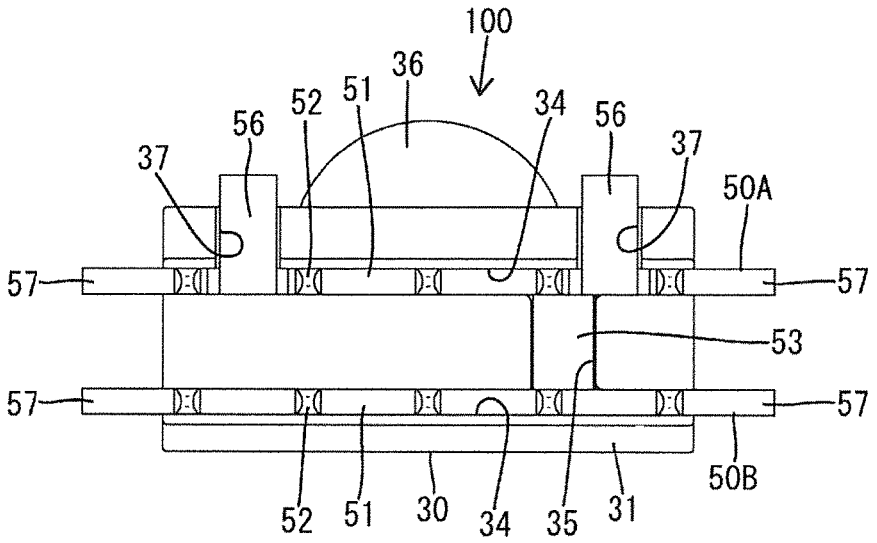
FIG. 6 is a front view of the subassembly

Further, as shown in FIG. 6, the correcting portions 56 project on both left and right sides of the front edge of the base 51 in the upper terminal 40A. As shown in FIGS. 2 and 4, the correcting portion 56 is a strip plate substantially U-shaped in a side view and cantilevered by being folded rearward in a curved manner after rising up from the front edge of the base 51. The correcting portion 56 is resiliently deformable in the vertical direction with the front edge of the base 51 as a support. When the holder 30 is inserted properly into the housing 10, the upper surfaces (plate surfaces facing upward) of the correcting portions 56 resiliently contact the upper surfaces of the contact receiving holes 24 and a state where the base 51 of the terminal 50A and the upper surfaces of the contact receiving holes 24 are separated by a predetermined distance can be maintained by resilient reaction forces of the correcting portions 56, as shown in FIG. 2. Note that the correcting portions 56 are not provided on the lower terminal 50B.

The capacitor 70 is an aluminum electrolytic capacitor and includes, as shown in FIG. 5, a substantially cylindrical capacitor body 71 and positive and negative lead wires 72 projecting forward from the front surface of the capacitor body 71. The lead wires 72 are round pins arranged at the same height while being spaced apart in a width direction.

Next, the holder 30 is described. The holder 30 is made of synthetic resin and, as shown in FIGS. 4 and 5, is composed of a terminal holding portion 32 located in a front end part, an electrical component holding portion 32 located in a rear end part and a connection region portion 33 located in an intermediate part between the terminal holding portion 31 and the electrical component holding portion 32.

As shown in FIG. 6, the terminal holding portion 31 is substantially in the form of a rectangular block and upper and lower terminal mounting grooves 34 are open in the front surface thereof. The terminal mounting groove 34 is a slit long and narrow in the width direction, and the base 51 and the front part of the electrical component connecting portion 53 of the terminal 50A, 50B are press-fit and mounted into this terminal mounting groove 34 from the front. The base 51 is stopped inside the terminal holding portion 31 and, as shown in FIG. 5, the rear part of the electrical component connecting portion 53 penetrates through the terminal mounting groove 34 and projects into the connection region 33. Then, the left and right end portions 57 of the base 51 of the terminal 50A, 50B project toward both left and right sides from the terminal holding portion 31. Further, as shown in FIG. 6, the terminal holding portion 31 is provided with a penetrating vertical hole 35 communicating with the upper and lower terminal mounting grooves 34. In the process of mounting the lower terminal 50B, a bent part of the electrical component connecting portion 53 passes inside the vertical hole 35.

The closing wall 36 is arcuate in a front view and is raised in a laterally central part of the upper surface of the terminal holding portion 31. An upper end part of the capacitor 70 held in the electrical component holding portion 32 is located in a rearward projection area of the closing wall 36.

The capacitor 70 is not seen from front by being hidden behind the closing wall 36 and the terminal holding portion 31.

Further, as shown in FIGS. 5 and 6, mounting recesses 37 are provided on both left and right sides across the closing wall 36 in an upper end part of the terminal holding portion 31. As shown in FIG. 2, the mounting recess 37 is formed by cutting the terminal holding portion 31 in a range from the upper surface of the terminal holding portion 31 to the upper terminal mounting groove 34 across the front surface. When the terminal 50A is mounted properly into the upper terminal mounting groove 34, the correcting portions 56 are arranged to enter the mounting recesses 37, thereby being prevented from projecting forward a large amount from the front surface of the terminal holding portion 31. Further, with the holder 30 properly inserted in the housing 10, the rear ends (free ends) of the correcting portions 56 are in contact with the upper surface of the terminal holding portion 31.

As shown in FIGS. 4 and 5, the electrical component holding portion 32 includes a hollow cylindrical holding body 38 extending along the front-rear direction. The front end of the holding body 38 is partitioned laterally by a column-like partition 39. The capacitor body 71 is inserted into the holding body 38 from behind to be held. With the capacitor body 71 held in the holding body 38, the partition 39 is arranged between the lead wires 72 and leading end parts of the lead wires 72 project into the connection region 33.

As shown in FIG. 5, the connection region 33 includes left and right side walls 41 facing each other, and a coupling portion 42 coupling rear end parts (end parts connected to the electrical component holding portion 32) of the side walls 41. The front ends of the side walls 41 are coupled integrally to the terminal holding portion 31. The coupling portion 42 can support the lead wires 72 of the capacitor 70 held in the electrical component holding portion 32 on the upper surface thereof. A space enclosed by the side wall portions 41, the terminal holding portion 31 and the electrical component holding portion 32 penetrates in the vertical direction, and unillustrated electrodes for resistance-welding the terminals 50A, 50B and the lead wires 72 can be arranged in this space.

The connector of this embodiment is structured as described above. Next, an assembling method and the like are described.

The terminals 50A, 50B are press-fit and mounted into the terminal mounting grooves 34 of the terminal holding portion 31 of the holder 30 to be retained. When the terminals 50A, 50B are mounted properly into the holder 30 so that the left and right end portions 57 of the bases 51 project toward both left and right sides from the terminal holding portion 31, the rear parts of the electrical component connecting portions 53 project into the connection region 33. Additionally, the correcting portions 56 enter the mounting recesses 37 at both left and right sides of the closing wall 36 and are arranged in an exposed manner in an upper part of the front end of the terminal holding portion 31.

Further, the capacitor 70 is inserted into the holding body 38 of the electrical component holding portion 32 of the holder 30 from behind. Then, the positive and negative lead wires 72 project into the connection region portion 33 and are arranged to overlap on the upper surfaces of the electrical component connecting portions 53 of the corresponding terminals 50A, 50B. In that state, the electrical component connecting portions 53 of the terminals 50A 50B and the lead wires 72 are connected by resistance welding. In this way, as shown in FIGS. 4 to 6, the subassembly 100 is obtained in which the terminals 50A, 50B, the capacitor 70 and the holder 30 are assembled integrally.

Subsequently, the holder 30 (subassembly 100) is inserted into the housing 10 from the front. Actually, the housing 30 is placed to stand with the front end opening thereof facing up and, in that state, the holder 30 is allowed to freely fall into the housing 10 with the electrical component holding portion 32 in the lead. At this time, the electrical component holding portion 32 holding the capacitor 70 is positioned into the electrical component accommodating portion 13 through the insertion hole 18 from the receptacle 11 and the terminal holding portion 31 holding the terminals 50A, 50B is positioned into the holder accommodating portion 12 through the opening 15 from the receptacle 11. Further, when the holder 30 is inserted properly, the housing press-fit portions 54 are press-fit into the press-fit holes 19 to be retained. In this way, the terminals 50A, 50B are held in the housing 10 and, eventually, the holder 30 is held in the housing 10 via the terminals 50A, 50B.

Further, as shown in FIGS. 1 and 2, when the holder 30 is inserted properly, the correcting portions 56 of the terminal 50A enter the contact receiving holes 24 and resiliently contact the upper surfaces of the contact receiving holes 24, and the rear ends of the correcting portions 56 resiliently contact the upper surface of the terminal holding portion 31. In this way, the correcting portions 56 are sandwiched resiliently in the vertical direction between the holder 30 and the housing 10.

If the holder 30 is in a horizontal posture to extend substantially along the front-rear direction in the housing 10, the respective tabs 52 of the terminals 50A, 50B are also in a horizontal posture. Thus, when the housing 10 is connected to the mating housing 90, the respective tabs 52 of the terminals 50A, 50B are connected properly to mating terminals and a connecting operation of the both housings 10, 90 can be performed without any trouble. On the other hand, if the holder 30 is in an oblique posture to be inclined with respect to the front-rear direction in the housing 10, the respective tabs 52 of the terminals 50A, 50B cannot be directly opposed to the mating terminals and the connecting operation of the housings 10, 90 may be impeded.

In that respect, in this embodiment, the correcting portions 56 contact the wall surfaces (upper surfaces of the contact receiving holes 24) on the side of the insertion hole 18, where the holder 30 is possibly inclined between the holder 30 and the housing 10 with the holder 30 inserted in the housing 10, from inside, and the holder 30 is pressed flat against the lower surface in the holder accommodating portion 12 due to resilient reaction forces of the correcting portions 56. As a result, the inclination of the holder 30 is corrected and the holder 30 is set to be in the horizontal posture together with the terminals 50A, 50B. Thus, when the housings 10, 90 are connected, a state where the respective tabs 52 of the terminals 50A, 50B are connected properly to the mating terminals is ensured. Further, the alignment of the terminals 50A, 50B with respect to the mating terminals is maintained to be constant in this way, with the result that a product-to-product variation is suppressed and quality can be improved.

In addition, since the correcting portions 56 project from the base 51 of the terminal 50A and are resiliently deformable, an assembling error of the holder 30 and the housing 10 can be absorbed within a resiliency range of the correcting portions 56. Thus, the holder 30 and the terminals 50A, 50B can be properly maintained in the horizontal posture.

Further, in the case of this embodiment, the correcting portions 56 are provided on both left and right sides of the terminal 50A and respectively contact parts on both left and right sides across the insertion hole 18 (upper surfaces of the contact receiving holes 24). Thus, the terminal 50A is held in a laterally well-balanced manner with respect to the housing 10 and, eventually, the holder 30 is held in a laterally well-balanced manner with respect to the housing 10.

Other embodiments are briefly described below.

The electrical component is not limited to a capacitor and may be a diode, a resistor, a transistor or the like.

The locking structure (housing press-fit portions, press-fit holes) may not be provided between the terminals and the housing and a locking structure may be provided between the housing and the holder.

The housing may not be provided with any special structure such as the contact receiving holes and contact parts of the correcting portions may be merely configured by general wall surfaces of the housing.

The holder may not be provided with any special structure such as the mounting recesses and the correcting portions may be merely arranged in an exposed manner on an outer side of a general wall surface of the holder.

The correcting portions may be supported on both ends coupled to a body part of the terminal.

LIST OF REFERENCE SIGNS

10 . . . housing
18 . . . insertion hole
24 . . . contact receiving hole
30 . . . holder
37 . . . mounting recess
50A, 50B . . . terminal
51 . . . base (body part)
56 . . . correcting portion
70 . . . capacitor (electrical component)
100 . . . subassembly

The invention claimed is:

1. A connector, comprising:

an electrical component having first and second lead wires;

first and second terminals, each of the terminals having a base, the first and second terminals being formed respectively with first and second electrical component connecting portions projecting from the base and configured to be connected respectively to the first and second lead wires of the electrical component, tabs projecting from the base of each of the terminals and configured for connection with a mating connector;

a holder for holding the first and second terminals and the electrical component; and a housing into which the holder holding the first and second terminals and the electrical component is to be inserted, wherein the first terminal further includes at least one correcting portion projecting from the base of the first terminal at a location spaced from the first electrical component connecting portion and spaced from the tabs of the first terminal, the at least one correcting portion coming into contact with the housing from inside for correcting an inclination of the holder in the housing.

2. The connector of claim 1, wherein the base of the first terminal has opposite front and rear edges, the first electrical component connecting portion projecting rearward from the rear end edge of the base of the first terminal, the tabs of the first terminal projecting forward from the front end edge of the base of the first terminal, the correcting portion being cantilevered from the front edge of the base of the first terminal and being bent rearward so that a projecting end of the correcting portion is opposed to and spaced from the base of the first terminal.

3. The connector of claim 1, wherein the second terminal has no correcting portion.

4. The connector of claim 1, wherein:

the housing includes an insertion hole through which the electrical component is to be inserted and a clearance is provided between the holder and a wall surface on a side where the insertion hole is located; and the correcting portion is configured to come into contact with the wall surface on the side where the insertion hole is located.

5. The connector of claim 4, wherein two correcting portions are provided to come into contact with both side parts of the wall surface of the housing across the insertion hole.

6. A connector comprising:

an electrical component;

a terminal to be connected to the electrical component;

a holder for holding the terminal and the electrical component; and a housing into which the holder holding the terminal and the electrical component is to be inserted, the housing including an insertion hole through which the electrical component is to be inserted and a clearance being provided between the holder and a wall surface on a side where the insertion hole is located; and wherein the terminal includes a correcting portion for correcting an inclination of the holder in the housing by coming into contact with the housing from inside, the correcting portion is configured to come into contact with the wall surface on the side where the insertion hole is located.

7. The connector of claim 6, wherein the correcting portion projects from a body of the terminal and is resiliently deformable.

8. The connector of claim 6, wherein two correcting portions are provided to come into contact with both side parts of the wall surface of the housing across the insertion hole.

* * * * *